US006350112B1

(12) United States Patent
Huang et al.

(10) Patent No.: US 6,350,112 B1
(45) Date of Patent: Feb. 26, 2002

(54) DUAL-DIRECTION PUMP FOR A BIKE

(76) Inventors: Ying-Che Huang, No. 3-1, Lane 572, Sec. 2, Chung Cheng Road; Chun-Ming Huang, No. 240, Chung Hwa W. Road, both of Chang Hwa City (TW)

( * ) Notice: Subject to any disclaimer, the term of this patent is extended or adjusted under 35 U.S.C. 154(b) by 0 days.

(21) Appl. No.: 09/721,683

(22) Filed: Nov. 24, 2000

(51) Int. Cl.[7] ..... F04B 23/04; F04B 7/00
(52) U.S. Cl. ..... 417/521; 417/518; 417/533
(58) Field of Search ..... 417/510, 511, 417/515, 516, 518, 521, 533

(56) References Cited

U.S. PATENT DOCUMENTS 4,334,839 A * 6/1982 Flagg ..... 417/536
5,443,370 A * 8/1995 Wang ..... 417/238
5,533,436 A * 7/1996 Chuang ..... 92/146
5,683,234 A * 11/1997 Chuang et al. ..... 417/531

* cited by examiner

*Primary Examiner*—Teresa Walberg
*Assistant Examiner*—Thor Campbell

(57) ABSTRACT

An air pump has a positioning seat provided to have two mouths each with an inner thread formed on an inner face thereof and an outer thread formed on an outer face thereof and a nozzle formed to adjust to an inlet of a tire; and two pump barrels each corresponding to one of the mouths to pump the air out from the nozzle. The two mouths of the positioning seat enables the user to operate the air pump in opposite directions simultaneously.

6 Claims, 6 Drawing Sheets

DUAL-DIRECTION PUMP FOR A BIKE

BACKGROUND OF THE INVENTION

1. Field of the invention

The present invention relates to dual direction pump, and more particularly to a pump that enables a user to pump air with both hands in opposite directions simultaneously so as to keep balance in opposite sides of the pump.

2. Prior Art Description

With reference to FIG. 1, a conventional air pump has a head 2 and a pump barrel 4. The head 2 includes a nozzle 6 for aligning with the inlet on the bike tire (not shown) and a positioning lever 8 for securing and releasing the engagement of the nozzle 6 to the inlet of the bike tire. The pump barrel 4 includes a cylinder 7, a pump spindle 5 reciprocally movable with respect to the cylinder 7 and a handle 10 securely engaged with the distal end of the pump spindle 5 to control the movement of the pump spindle 5.

When the pump is in use, the user aligns the nozzle 6 with the inlet of the bike tire and pivots the positioning lever 8 to secure the engagement between the nozzle 6 and the inlet of the bike tire. Then, the user holds the handle 10 to move the pump spindle 5 reciprocally within the cylinder 7 to pump the air into the bike tire. However, due to the design of this kind of pump, the user can only operate the pump in one direction. That is, the user can only use the right hand to control the movement of the pump spindle 5 and the left hand to overcome the displacement caused by the reciprocal movement of the pump spindle 5. Furthermore, due to the movement of the right hand and the holding to the handle 10, a distance of the pump spindle 5 is wasted. Again, when the air pump of this kind is not in use, because the structure is fixed, the air pump takes a large space in storage.

The present invention provides an improved air pump enabling the user to operate the pump in two opposite directions simultaneously to readily balance the force applied to the air pump to overcome the above mentioned shortcomings.

SUMMARY OF THE INVENTION

The primary objective of the invention is to provide an improved air pump having two handles, two pump spindles a distal end of which is securely connected to one of the handles and two pump barrels each having one of the pump spindles reciprocally received therein. With such a structure, the air pump in accordance with the present invention enables the user to operate the air pump in two opposite directions easily.

Another objective of the invention is to provide an improved air pump having two foldable handles, such that the air pump takes only little space when stored.

Other objects, advantages and novel features of the invention will become more apparent from the following detailed description when taken in conjunction with the accompanying drawings.

Figure 3A:
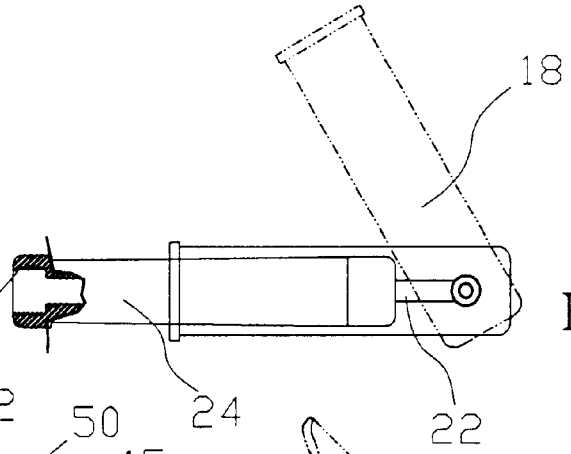
Figure 3B:
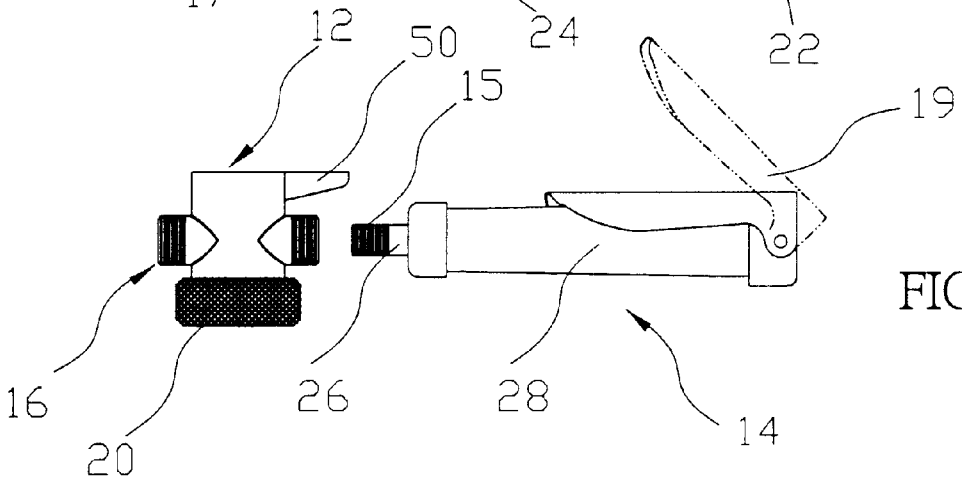
Figure 3C:
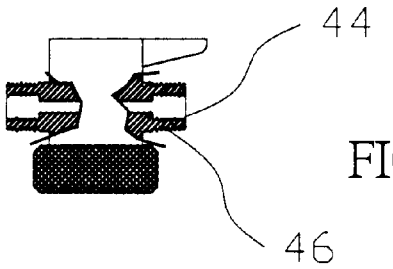
Figure 4A:
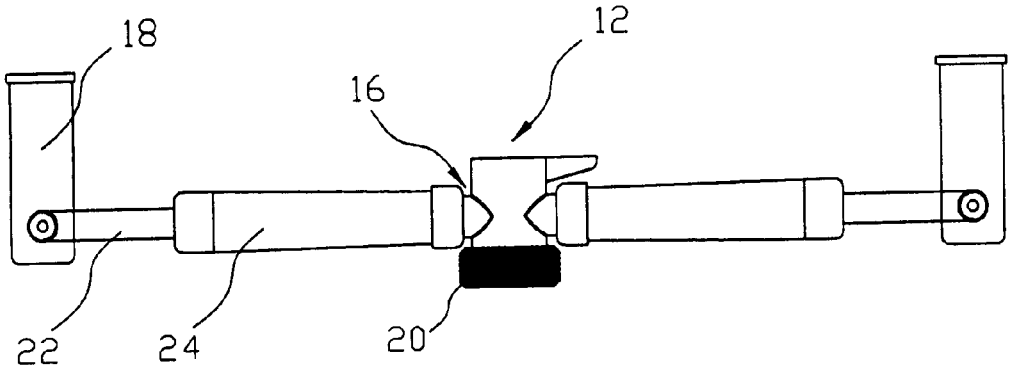
Figure 4B:
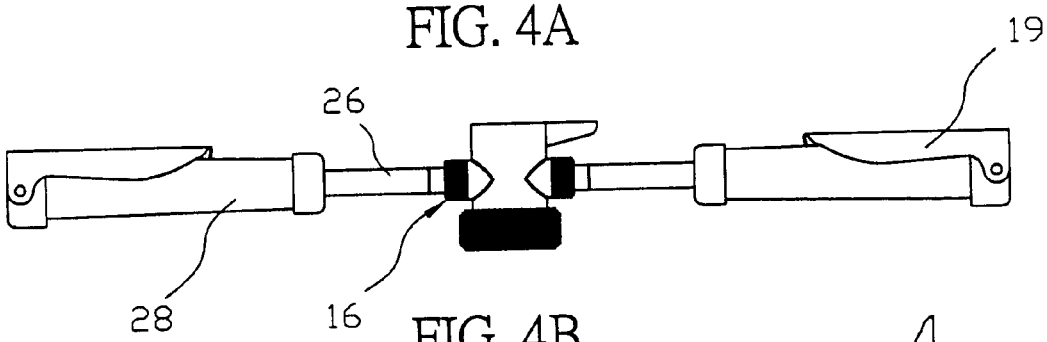
Figure 4C:
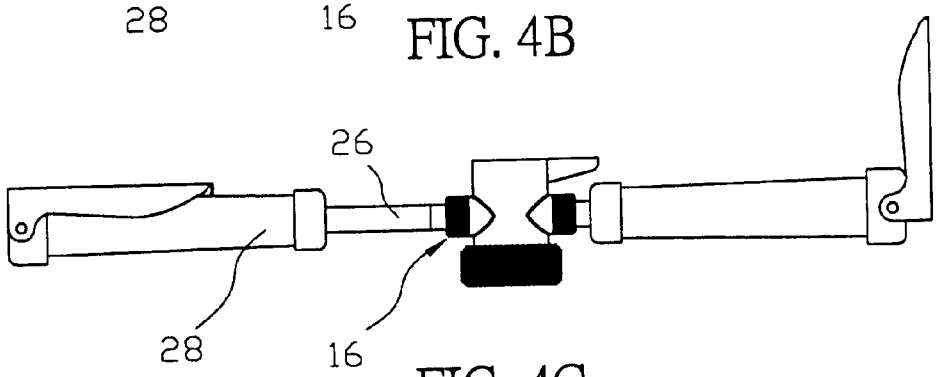
Figure 4D:
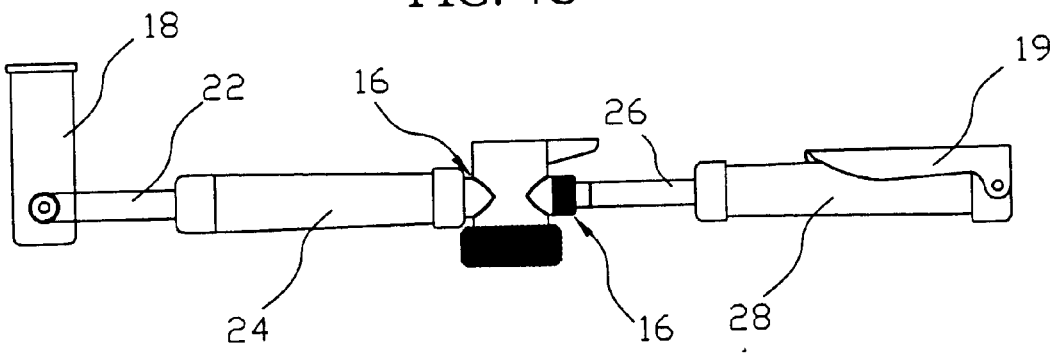
Figure 5:
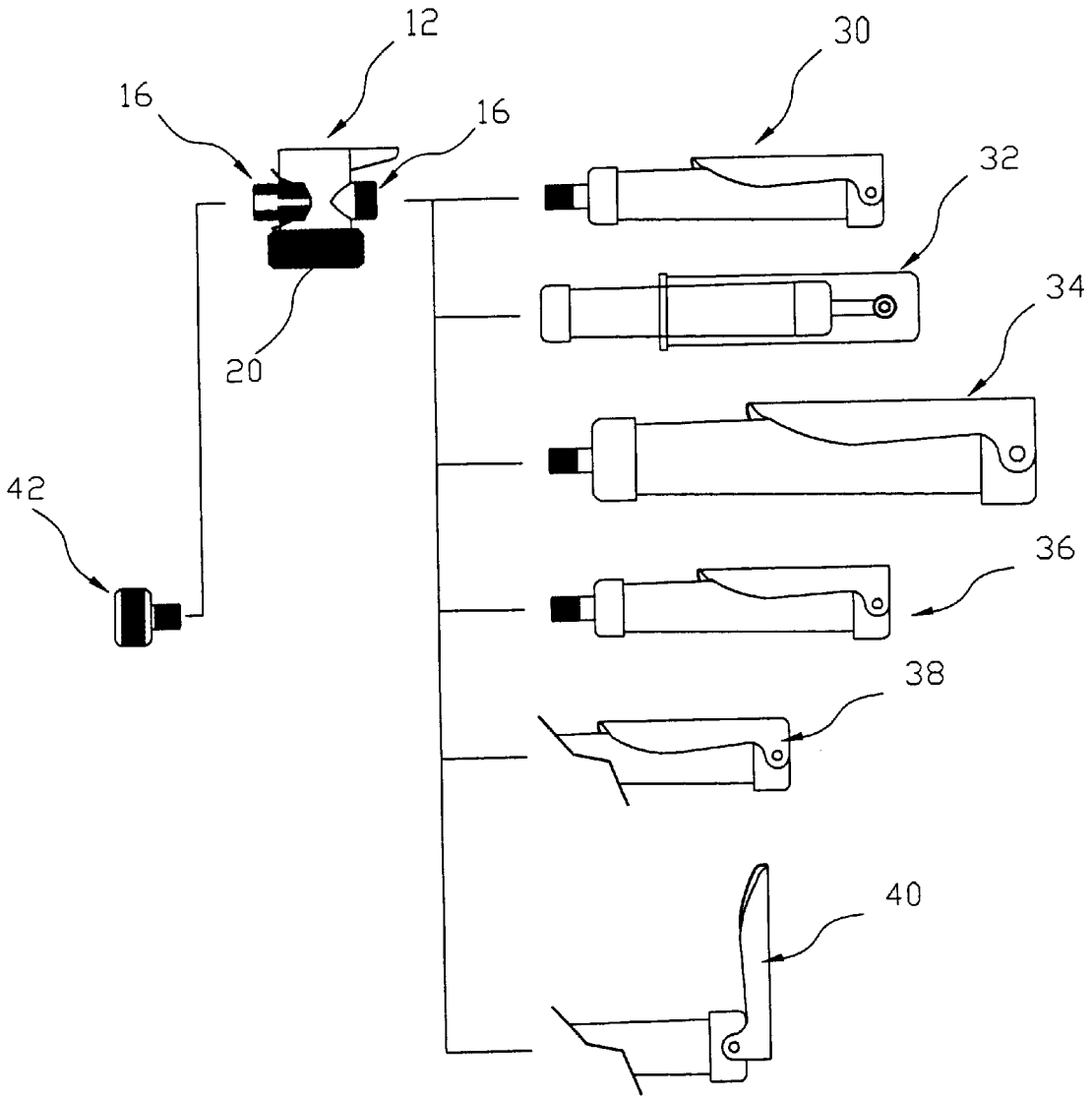
Figure 6:
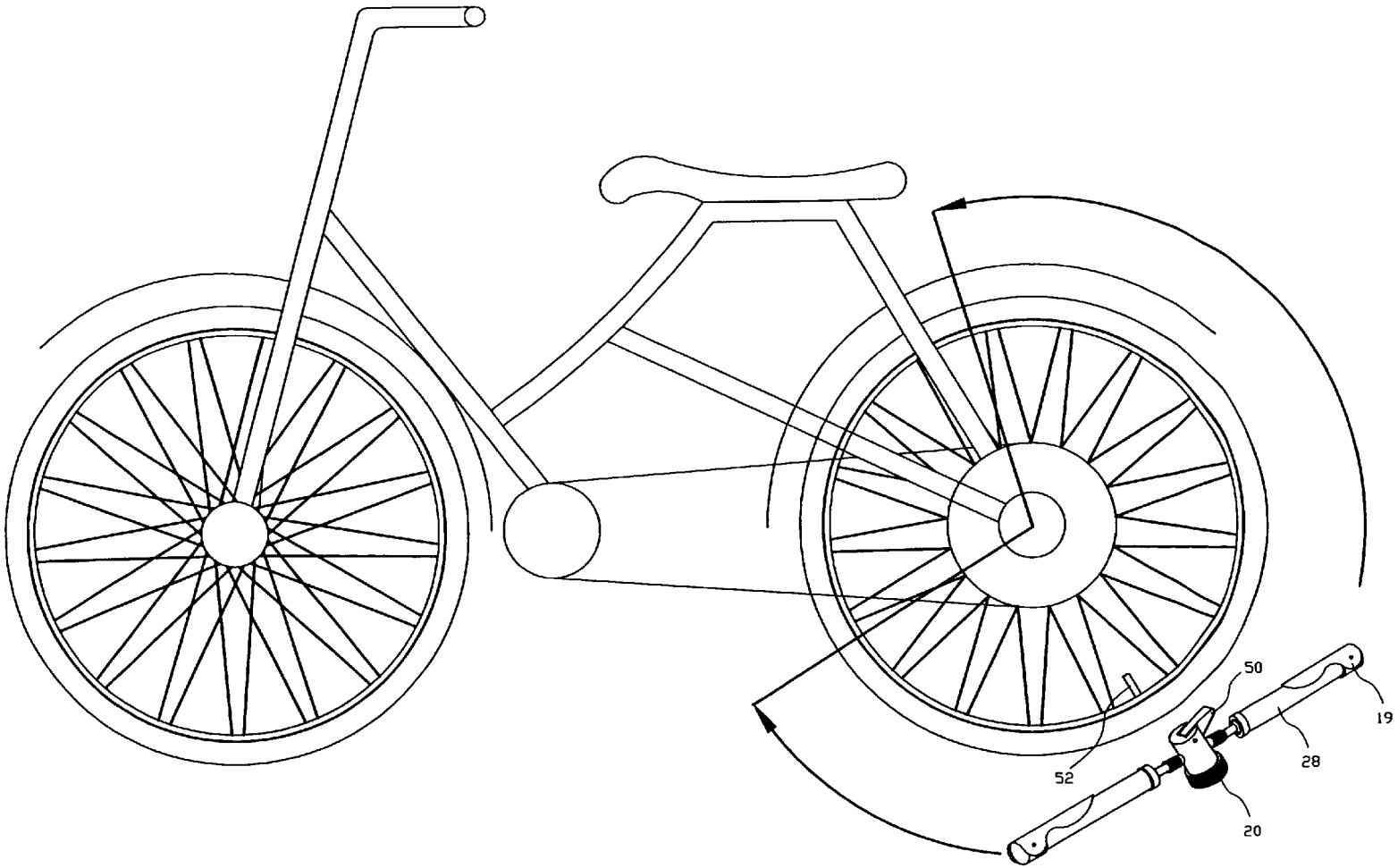

exploded perspective view of the device of the invention;

FIG. 3A is a schematic side view showing the structure of the body of the air pump of the present invention;

FIG. 3B is a schematic side view showing the structure of the body of another preferred embodiment of the air pump of the present invention;

FIG. 3C is a partial side view in section showing the structure of the positioning seat of the air pump of the present invention;

FIG. 4A~FIG. 4D are schematic views showing different combinations of embodiments in accordance with the present invention;

FIG. 5 is a schematic view showing the positioning seat of the invention in combination with different bodies of the air pumps in accordance with the present invention; and FIG. 6 is a schematic view showing the implementation of the air pump of the present invention to a bike.

DETAILED DESCRIPTION TO THE PREFERRED EMBODIMENT

Figure 1:
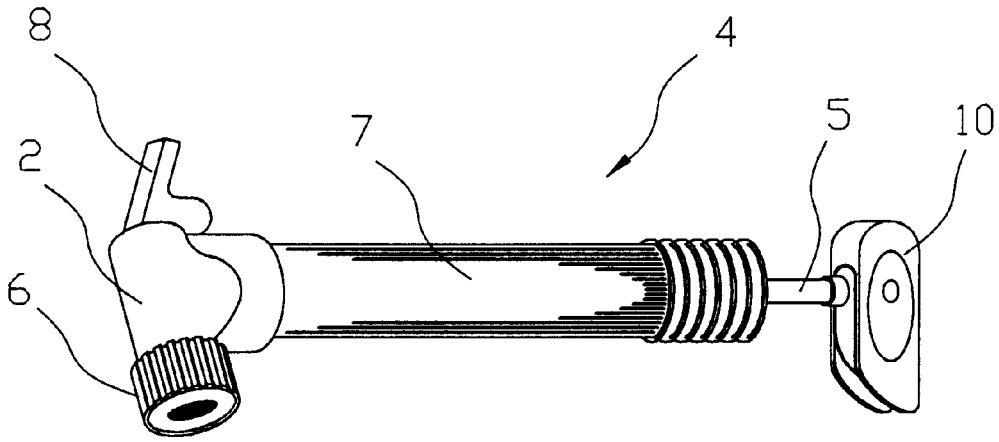
PRIOR ART FIG. 1
FIG. 1 is a perspective view of a conventional air pump.
Figure 2:
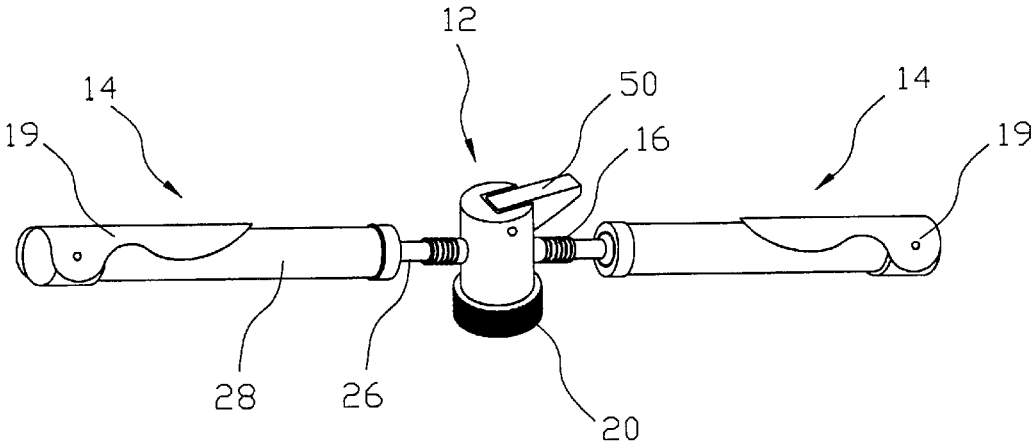
FIG. 2 is a perspective view of an air pump constructed in accordance with the present invention.

With reference to FIGS. 1, and 2, an air pump constructed in accordance with the present invention includes a positioning seat 12 and two pump barrels 14 each detachably connected to opposite sides of the positioning seat 12. The positioning seat 12 has two connectors 16 oppositely and integrally formed with the positioning seat 12, a nozzle 20 for connecting with the inlet of the bike tire (not shown) and a retainer 50 for securing the engagement between the nozzle 20 and the inlet of the bike tire once the nozzle 20 engages with the inlet of the bike tire. Each of the connectors 16 has an inner thread 44 and an outer thread 46 formed to connect with different embodiments of the pump barrels 14, as shown in FIGS. 3A, 3B and 3C. With the outer thread 46, the positioning seat 12 is able to connect to an inner thread 17 of a body 24 of the air pump of the invention directly, wherein the body 24 has a pump spindle 22 extending out to connect to the handle 18. With the inner thread 44, the positioning seat 12 is able to correspond to an outer thread 15 of a pump spindle 26 extending out from a body 28 of the pump barrel 14, as shown in FIG. 3B, wherein the body 28 has a handle 19 foldable with respect to the body 28.

With reference to FIGS. 4A~4D, with the inner thread 44 and outer thread 46, the positioning seat 12 is able to connect directly to a pump spindle 26, as shown in FIG. 3B, or directly to the body 24, as shown in FIG. 3A.

It is to be noted that whether the positioning seat 12 is connected to a pump spindle 26 or a body 24, the user is able to hold the handles 18,19 with both hands to simultaneously push the spindle 22 or the body 28 to operate the air pump in two opposite directions. As shown in FIG. 5, with the positioning seat 12, different pump barrels 30, 32, 34, 36, 38 and 40 of different specifications are able to respectively connect to the positioning seat 12 according to various requirements. For example, the pump barrel 38 is suitable for children and pump barrel 40 with the handle vertical relative to the body 24 or 28 is adapted for different users. Furthermore, should only one side of the positioning seat 12 be necessary, may a plug 42 be provided to have air tight engagement with one side of the positioning seat 12.

With reference to FIG. 6, when the air pump of the invention is used to pump air into an inlet 52 of a bike tire, due to the special design to have two handles 18 or 19, the user is able to have large space to operate the air pump. That is, the user will not need to adjust the inlet 52 to a lower position to operate the air pump, the user is able to operate the air pump directly even the inlet 52 is far away from the ground.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An air pump comprising:

a positioning seat having two mouths each with an inner thread formed on an inner face thereof and an outer thread formed on an outer face thereof and a nozzle formed to adjust to an inlet of a tire; and two pump barrels each corresponding to one of the mouths to pump the air out from the nozzle.

2. The air pump as claimed in claim 1, wherein the pump barrel has a body, a pump spindle reciprocally movable with respect to the body and a handle securely connected to a distal end of the pump spindle.

3. The air pump as claimed in claim 2, wherein the handle is foldable relative to the pump spindle.

4. An air pump comprising:

a positioning seat having two mouths each with an inner thread formed on an inner face thereof and an outer thread formed on an outer face thereof and a nozzle formed to adjust to an inlet of a tire;

a pump barrel corresponding to one of the mouths to pump the air out from the nozzle; and a plug inserted into one of the mouths to have air tight engagement with the mouth.

5. The air pump as claimed in claim 4, wherein the pump barrel has a body, a pump spindle reciprocally movable with respect to the body and a handle securely connected to a distal end of the pump spindle.

6. The air pump as claimed in claim 5, wherein the handle is foldable relative to the pump spindle.

* * * * *